US009976830B2

(12) United States Patent
Leone

(10) Patent No.: US 9,976,830 B2
(45) Date of Patent: May 22, 2018

(54) FIREARM BARREL INCLUDING A GAS PRESSURE RELIEF CHAMBER

(71) Applicant: Russell Leone, Alexandria, MN (US)

(72) Inventor: Russell Leone, Alexandria, MN (US)

( * ) Notice: Subject to any disclaimer, the term of this patent is extended or adjusted under 35 U.S.C. 154(b) by 0 days. days.

(21) Appl. No.: 14/882,428

(22) Filed: Oct. 13, 2015

(65) Prior Publication Data

US 2016/0109204 A1 Apr. 21, 2016

Related U.S. Application Data

(60) Provisional application No. 62/064,449, filed on Oct. 15, 2014.

(51) Int. Cl.
*F41A 21/28* (2006.01)
*F41A 21/18* (2006.01)

(52) U.S. Cl.
CPC ..... *F41A 21/28* (2013.01); *F41A 21/18* (2013.01)

(58) Field of Classification Search
CPC ..... F41A 21/02; F41A 21/04; F41A 21/18; F41A 21/24; F41A 21/28
USPC ..... 42/78; 89/14.7
See application file for complete search history.

(56) References Cited

U.S. PATENT DOCUMENTS 2,935,912 A * 5/1960 Hartley ..... F41A 13/12 42/76.02
3,727,513 A * 4/1973 Wicks ..... F41A 13/12 89/14.05
5,097,614 A * 3/1992 Strong ..... F41A 21/28 42/76.01
5,136,923 A * 8/1992 Walsh, Jr. ..... F41A 21/30 89/14.2
5,355,765 A * 10/1994 Rogers ..... F41A 13/12 89/14.4
2011/0265365 A1* 11/2011 Alonso Tricio ..... F41A 21/02 42/78

FOREIGN PATENT DOCUMENTS

FR 2756041 * 5/1998

* cited by examiner

*Primary Examiner* — Stephen Johnson

(57) ABSTRACT

Described herein is a firearm barrel operable to manage gas pressure behind a projectile traveling through the firearm barrel. The design of the firearm barrel enables a firearm to be discharged at a low-report by managing gas pressure behind a bullet while the bullet is under compression from the barrel. In embodiments, the firearm barrel includes an inner barrel having at least one opening in its surface and an outer tube surrounding the inner barrel, such that a chamber is created between the inner barrel and outer tube, the chamber being operable to temporarily retain gases that are generated as a result of discharging a firearm. The gases may pass from the barrel into the chamber through the at least one opening, and the gases may be temporarily retained within the chamber before escaping back through the at least one opening and out of the barrel behind a discharged projectile.

7 Claims, 4 Drawing Sheets

FIREARM BARREL INCLUDING A GAS PRESSURE RELIEF CHAMBER

CROSS REFERENCE TO RELATED APPLICATION

This application is a non-provisional application claiming the benefit of U.S. Provisional Application Ser. No. 62/064,449, entitled "Firearm Barrel Including a Gas Pressure Relief Chamber," which was filed on Oct. 15, 2014, and is incorporated herein by reference in its entirety.

TECHNICAL FIELD

This disclosure relates to a firearm barrel operable to reduce the report of a firearm and to manage pressure behind a bullet traveling through the barrel.

BACKGROUND

Upon the discharging of any firearm, the movement of a bullet through the barrel of the firearm is initiated by the ignition of gunpowder contained within the round, causing the rapid expansion of gas, which forces the round through and out of the barrel at high speed. The expanding gas is confined to the small space contained within the barrel, forcing it towards the only open area, the muzzle, at high pressure where it exits the barrel. The gas is then free to expand and dissipate in open space after both the gas and the round have left the confines of the lands and grooves of the barrel.

Currently, efforts to manage the expansion of gas and corresponding loud sound and pressure associated with the discharging of a firearm focus on containing the gas after the gas exits the muzzle, following the round, through an attachment (often referred to as a "can," "suppressor," or "silencer") which provides numerous baffled chambers and greater volume for expansion than that of the barrel. In some instances, a can may be integrated with the barrel of the firearm and may be referred to as an integral barrel. Coupled with subsonic ammunition, which is designed to travel at less than the speed of sound, the report of a barrel equipped with such an attachment, or integral barrel, can be significantly reduced.

Current means of enhancing safety and reducing the report of a firearm are not fully satisfactory and have inefficiencies and barriers to use. Attachments are state regulated and expensive, oftentimes greatly exceeding the cost of the firearm itself. Subsonic ammunition is also more expensive than standard ammunition. Furthermore, subsonic ammunition is not nearly as readily available as standard ammunition. Therefore, a need exists for a barrel that allows a firearm to be used where the speed of a round and gas pressure resulting from discharging a round from the firearm can be managed without requiring additional attachments, components, baffling, or special ammunition.

BRIEF DESCRIPTION OF THE DRAWINGS

Like reference numbers and designations in the various drawings indicate like elements.

DETAILED DESCRIPTION

Figure 1A:
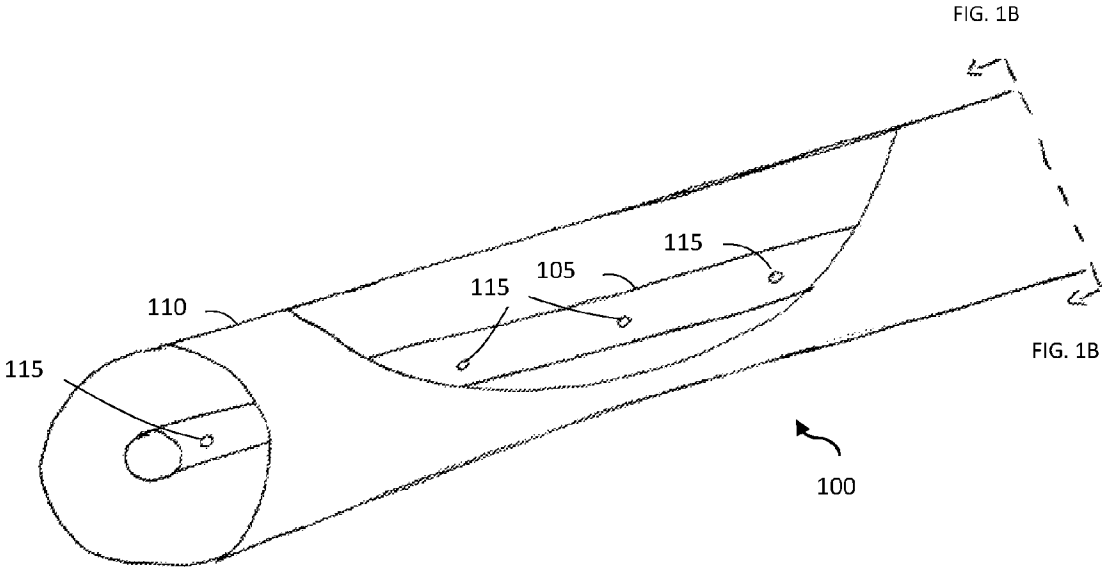
FIG. 1A is a perspective view of a firearm barrel showing an inner barrel through a cut-away of an outer tube.

As a preliminary matter, it will be readily understood by those persons skilled in the art that the present invention is susceptible of broad utility and application. Many methods, embodiments, and adaptations of the present invention other than those herein described, as well as many variations, modifications, and equivalent arrangements will be apparent from or reasonably suggested by the present invention and the following description thereof without departing from the substance or scope of the present invention. Accordingly, while the present invention has been described herein in detail in relation to preferred embodiments, it is to be understood that this disclosure is only illustrative and exemplary of the present invention and is made merely for the purpose of providing an enabling disclosure of the invention. The following disclosure is not intended nor is to be construed to limit the present invention or otherwise to exclude any such other embodiments, adaptations, variations, modifications and equivalent arrangements.

Described herein is a firearm barrel operable to manage gas pressure behind a bullet traveling through the firearm barrel. The design of the firearm barrel described herein enables a firearm to be discharged at a low-report by managing gas pressure behind a bullet while the bullet is still under compression from the firearm barrel. The firearm barrel described herein may produce a lower noise level than the noise level associated with discharging a firearm having a normal barrel of similar length and caliber. In embodiments, the firearm barrel described herein comprises a chamber operable to temporarily detain the gases that are generated as a result of discharging a firearm.

The barrel described herein is further operable to reduce the speed of a bullet traveling through the barrel by managing gas pressure created during the discharging of the firearm. When a round is discharged from a firearm's chamber, gas pressure generated from the ignition of gunpowder forces the bullet down the length of the firearm's barrel. By managing gas pressure in the barrel throughout the firing process, the barrel described herein serves to reduce the speed of a discharged round without the need for specially designed attachments (e.g., silencer or can) or ammunition (e.g., subsonic ammunition).

In embodiments, the firearm barrel described herein comprises an inner barrel that is axially surrounded by an outer tube. It should be understood that slight variations may be made to the firearm barrel such that the firearm barrel may be installed to replace the standard barrel of various types of firearms. When a round is discharged from the chamber of the barrel and the bullet reaches a predetermined point in the barrel, a portion of the expanding gases are vented through one or more openings in the barrel (e.g., slots and/or holes) into a sealed containment chamber. The sealed containment chamber is created in a void area between the inner barrel and the outer tube, and the void area is sealed at both ends. As gases are vented into the containment chamber, gas pressure within the inner barrel is reduced and the bullet continues down the barrel at a reduced speed. After the bullet exits the barrel's muzzle, the gases that are temporarily retained in the containment chamber pass back into the inner barrel through the same openings through which they were initially released from the inner barrel and the remaining gases exit through the muzzle behind the bullet.

The firearm barrel described herein enables a low-report discharging of a firearm with the firearm barrel installed. When a bullet exits a typical firearm barrel, all of the gas pressure generated during the firing process is allowed to rapidly expand when the gas pressure exits the compressed barrel. The firearm barrel that is described herein controls the gas pressure within the firearm barrel before a bullet exits the barrel. In embodiments, gas pressure behind the bullet may be controlled while the bullet is still within the control of the firearm barrel's lands and grooves. It should be understood that various portions of gas pressure generated during the firing process may be vented to a sealed chamber surrounding an inner barrel to reduce or eliminate the blast created from the rapid expansion of gas pressure exiting a firearm barrel behind a bullet.

An embodiment of the invention described herein may include a firearm barrel comprising: (a) an inner barrel having a first diameter, wherein the inner barrel comprises at least one opening on the surface of the inner barrel; (b) an outer tube surrounding the inner barrel, wherein the outer tube has a second diameter; (c) wherein the first diameter and second diameter are so dimensioned as to create a space between the outer surface of the inner barrel and the inner surface of the outer tube.

According to an embodiment of the invention described herein, the inner barrel comprises a chamber-mount end and a muzzle end, and the outer tube surrounds the inner barrel for the entire length of the inner barrel.

According to an embodiment of the invention described herein, the chamber-mount end of the inner barrel comprises a temporary mount for temporarily affixing the inner barrel to the chamber of a firearm.

According to an embodiment of the invention described herein, the chamber-mount end of the inner barrel comprises a permanent mount for permanently affixing the inner barrel to the chamber of a firearm.

According to an embodiment of the invention described herein, the inner barrel comprises a plurality of openings on the surface of the inner barrel.

According to an embodiment of the invention described herein, the at least one opening on the surface of the inner barrel is located in a portion of the inner barrel that extends from the chamber-end of the inner barrel to the center of the axis of the inner barrel.

According to an embodiment of the invention described herein, the gap between the outer surface of the inner barrel and the inner surface of the outer tube creates a void, and the void is sealed at both ends.

According to an embodiment of the invention described herein: (a) gases emitted during the discharge of a firearm are forced through the at least one opening in the surface of the inner barrel into the void after a projectile is discharged from a chamber associated with the firearm and into the inner barrel; (b) the gases that are forced into the void are retained within the void until the projectile exits the inner barrel; and (c) when the projectile exits the inner barrel, the gases that are retained within the void are released through the at least one opening in the surface of the inner barrel into the inner barrel.

According to an embodiment of the invention described herein, the gap between the outer surface of the inner barrel and the inner surface of the outer tube creates a void, and the void is sealed at the muzzle end with a cap that comprises a hole aligned with the muzzle of the inner barrel and further comprises threads that mesh with threads located on the outer surface of the inner barrel.

According to an embodiment of the invention described herein, the chamber-mount end of the inner barrel is aligned with the chamber of a firearm such that the chamber-mount end of the inner barrel accepts a projectile discharged from the chamber.

According to an embodiment of the invention described herein, the interior surface of the inner barrel comprises lands and grooves.

An embodiment of the invention described herein may include a method of making a firearm barrel, the method comprising the steps of: (a) forming an inner barrel having a first diameter; (b) punching at least one opening through the surface of the inner barrel; (c) forming an outer tube surrounding the inner barrel, wherein the outer tube has a second diameter; (d) wherein the first diameter and second diameter are so dimensioned as to create a space between the outer surface of the inner barrel and the inner surface of the outer tube.

According to an embodiment of the invention described herein: (a) the inner barrel comprises a chamber-mount end and a muzzle end, and the outer tube surrounds the inner barrel for the entire length of the inner barrel; and (b) attaching a temporary mount at the chamber-mount end of the inner barrel, the temporary mount being operable to temporarily affix the inner barrel to the chamber of a firearm.

According to an embodiment of the invention described herein, the method of making the firearm barrel further comprises: (a) wherein the inner barrel comprises a chamber-mount end and a muzzle end, and wherein the outer tube surrounds the inner barrel for the entire length of the inner barrel; and (b) attaching a permanent mount at the chamber-mount end of the inner barrel, the permanent mount being operable to permanently affix the inner barrel to the chamber of a firearm.

According to an embodiment of the invention described herein, the at least one opening on the surface of the inner barrel is located in a portion of the inner barrel that extends from the chamber-end of the inner barrel to the center of the axis of the inner barrel.

According to an embodiment of the invention described herein, the method of making the firearm barrel further comprises: (a) wherein the space between the outer surface of the inner barrel and the inner surface of the outer tube creates a void; and (b) sealing the void at both ends.

According to an embodiment of the invention described herein, the at least one opening punched through the surface of the inner barrel is dimensioned such that: (a) gases emitted during the discharge of a firearm are forced through the at least one opening in the surface of the inner barrel into the void after a projectile is discharged from a chamber associated with the firearm and into the inner barrel; (b) the gases that are forced into the void are retained within the void until the projectile exits the inner barrel; and (c) when the projectile exits the inner barrel, the gases that are retained within the void are released through the at least one opening in the surface of the inner barrel into the inner barrel.

According to an embodiment of the invention described herein, the method of making the firearm barrel further comprises: (a) wherein the space between the outer surface of the inner barrel and the inner surface of the outer tube creates a void; and (b) sealing the muzzle end of the void with a cap that comprises a hole aligned with the muzzle of the inner barrel and further comprises threads that mesh with threads located on the outer surface of the inner barrel.

According to an embodiment of the invention described herein, the method of making the firearm barrel further comprises aligning the chamber-mount end of the inner barrel with the chamber of a firearm such that the chamber-mount end of the inner barrel accepts a projectile discharged from the chamber.

According to an embodiment of the invention described herein, the method of making the firearm barrel further comprises forming a series of lands and grooves along the interior surface of the inner barrel.

FIG. 1A is a perspective view of a firearm barrel 100 showing an inner barrel 105 through a cut-away of an outer tube 110. The inner barrel 105 may be open at both ends. When the firearm barrel 100 is installed with other firearm components, one end (e.g., a chamber end) of the inner barrel 105 may be positioned at the chamber of the firearm, and the other end of the inner barrel (e.g., the muzzle end) may be left open. It should be understood to those skilled in the art that the inner barrel 105 may be made out of a wide variety of materials. For example, the inner barrel 105 may be made out of a material that can withstand the heat and pressure that result from the firing of a bullet through the inner barrel 105. It should be further understood by those with skill in the art that the inner barrel 105 may be made at various lengths and that the inner radius of the inner barrel 105 may vary according to the caliber bullet intended for use with the firearm barrel 100. For example, the length of inner barrel 105 may vary according to the intended function of the firearm intended for use with the firearm barrel 100.

In embodiments, the inner barrel may include one or more openings 115. The number and size of the openings 115 may vary according to the type of firearm that is to be used with the firearm barrel 100. For example, the number and size of openings 115 may vary based upon the caliber bullet that is to be fired through the firearm barrel 100, the grain weights of bullets intended for use with the firearm, length of the firearm barrel 100, as well as other factors. Increasing the number and/or size of the openings 115 may allow for better management of a greater amount of gas pressure by allowing more gas to be vented from the inner barrel 105.

In embodiments, the diameter of the inner barrel 105 and the diameter of the outer tube 110 may be dimensioned such that a void area is created between the outer surface of the inner barrel 105 and the inner surface of the outer tube 110. The void area between the inner barrel and outer tube may provide a gas pressure relief chamber 120 for temporarily detaining gases released during the discharging of a firearm. It should be understood that the diameters of the inner barrel and outer tube can be dimensioned such that the volume of the void area between the inner barrel and outer tube is sufficient for detaining a certain portion of the gases created during the discharging of the firearm.

In embodiments, the chamber 120 created by the void area between the inner barrel 105 and outer tube 110 can be sealed at both ends. It should be understood that various components may be used to prevent gas from escaping out of either end of the chamber. As an example, each end of the chamber 120 may be sealed using a gasket (e.g., O-ring), threaded end-cap, and/or various other components. The chamber-end of the firearm barrel 100 may be sealed during installation of the firearm barrel 100 with other firearm components. It will be appreciated that the seal at either end of the firearm barrel 100 may be made from various materials.

When a round is fired in the chamber of a firearm, gases may travel through the one or more openings 115 into the chamber 120 as the bullet travels through the inner barrel 105. The chamber 120 can detain the captured gases until the bullet exits the inner barrel 105. After the bullet exits the inner barrel 105, the captured gases can escape the chamber 120 back through the opening(s) 115 and out the inner barrel 105.

When a round is fired in the chamber of a firearm, the gas pressure exerted from the firing of the round is dependent on several different factors. For example, larger caliber ammunition and ammunition having higher grain weights typically exert greater gas pressure when fired. Gas pressure within the inner barrel 105 may be manipulated through the number and size of the openings 115. The gas pressure may be manipulated such that the speed of the bullet is reduced to a desired speed. For example, increasing the number of openings 115 within the inner barrel 105 and/or increasing the size of openings 115 can allow a greater amount of gas pressure to escape into the chamber 120 between the inner barrel 105 and outer tube 110, thereby reducing the speed of the bullet as it travels through the inner barrel 105. It should be understood that the number and size of the openings 115 can vary according to the amount of gas pressure that needs to be released from the inner barrel 105 to reduce the speed of the bullet to a desired speed.

The location of the one or more openings 115 may vary according to the type of firearm that is to be used with the firearm barrel 100. For example, the positioning of the one or more openings 115 may be varied according to a location within the inner barrel 105 at which it is desired for the speed of the bullet to be reduced. For example, the speed of a bullet may be reduced earlier in the firing process by placing one or more openings 115 closer in the barrel 105 to the chamber of a firearm, and the speed of the bullet may be reduced later in the firing process by placing one or more openings 115 closer to the muzzle end of the barrel 105. It will be appreciated by those skilled in the art that the configuration of openings 115 in the inner barrel 105 can be altered to achieve various levels of control over gas pressure forcing a bullet through the inner barrel 105.

In embodiments, a plurality of openings 115 may be punched in the surface of the inner barrel 105. While the plurality of openings 115 are shown at a section of the inner barrel between the axial center of the inner barrel 105 and the chamber-end of the inner barrel 105 (e.g., the end of the inner barrel 105 for accepting a projectile from a chamber 405), it should be understood that the openings 115 may be located at various positions along the inner barrel 105, including the portion of the barrel between the axial center of the barrel and the muzzle-end of the barrel (e.g., the end of the inner barrel 105 through which a projectile exits the inner barrel 105).

It should be understood that the shape of the openings 115 may also be varied to alter the amount of gas pressure that is allowed to escape from the inner barrel 105 into the chamber 120 created between the inner barrel 105 and outer tube 110.

Altering the configuration of the openings 115 (e.g., number of openings, size of openings, shape of openings, positioning of openings, etc.) may allow various levels of control to be obtained over the gas pressure traveling behind a bullet. The chamber 120 can temporarily retain gas so that the compression of gas behind the bullet and the amount of gas immediately following the bullet upon exit from the firearm barrel 100 are reduced. The temporarily retained gas that is vented to the chamber 120 may then be allowed to exit the firearm barrel 100 at a reduced pressure.

Figure 1B:
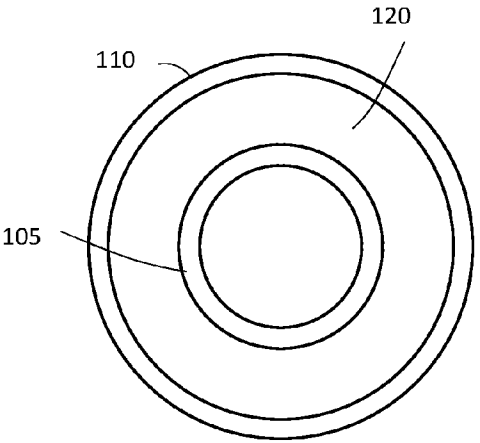
FIG. 1B is a cross-sectional view looking down the axis of a firearm barrel, the view showing an inner barrel, a gas pressure relief chamber, and an outer tube.

FIG. 1B is a cross-sectional view looking down the axis of a firearm barrel 100, the view showing an inner barrel 105, an outer tube 110, and a gas pressure relief chamber 120. The volume of the gas pressure relief chamber 120 may be altered by varying the difference between the radius of the inner barrel 105 and the outer tube 110. In embodiments, the volume of the gas pressure relief chamber 120 may be based upon the gas pressure anticipated from the firing of a round from an associated firearm. For example, larger caliber ammunition and/or heavier grain weight ammunition may create greater pressure in the inner barrel 105 when the ammunition is fired from the chamber of a firearm. The volume of the gas pressure relief chamber 120 can be greater when the firearm barrel 100 is intended for use with larger caliber ammunition and/or heavier grain weight ammunition. The larger gas pressure relief chamber 120 can relieve and detain a greater amount of gas pressure from the inner barrel 105 such that the speed of a bullet may be reduced to a desired speed while traveling through the inner barrel 105. It should be understood that the bore of the inner barrel 105 may have various configurations of lands and grooves.

It should be understood that the thickness (i.e., caliper) of the inner barrel 105 and the outer tube 110 may be of various dimensions. For example, the caliper of the inner barrel 105 may be based on the caliber of round for which the barrel is designed. In one embodiment, the caliper of the outer tube 110 may be smaller than the caliper of the inner barrel 105.

Figure 2A:
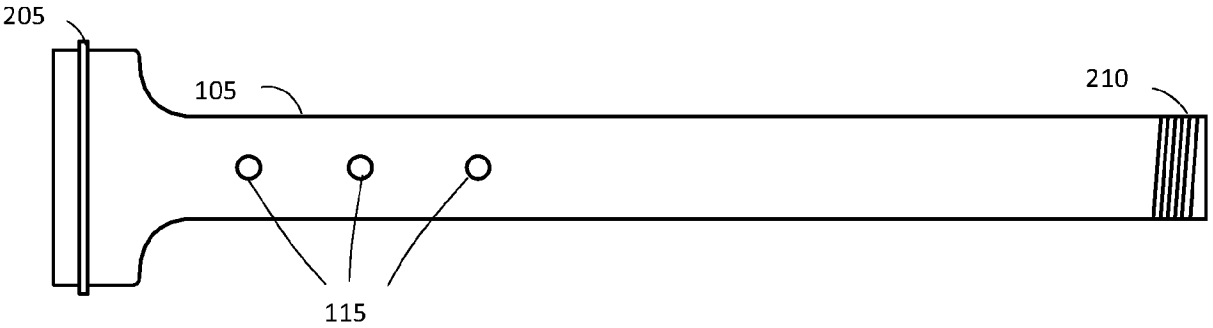
FIG. 2A is a view of the inner barrel.

FIG. 2A is a view of the inner barrel 105. The inner barrel 105 may be of a constant outer diameter for a significant length of the inner barrel 105, and a chamber end of the inner barrel 105 may be of a greater diameter than the diameter of the rest of the inner barrel 105. For example, the chamber end of the inner barrel 105 may be of a diameter that is slightly less than the inner diameter of the outer tube 110 of FIG. 1A. The inner diameter of the inner barrel 105 may be a constant diameter throughout the length of the inner barrel 105 to allow a projectile to travel through the inner barrel 105 under pressure.

In embodiments, the inner barrel 105 may be open at both ends. For example, one end of the inner barrel 105 (e.g., the chamber end) can open to the chamber of the firearm to accept a projectile (e.g., bullet) when the projectile is fired from the chamber, and the other end of the inner barrel 105 (e.g., the muzzle end) can be open to allow the projectile and gases emitted from the firing of the round to be projected from the inner barrel 105.

In embodiments, the inner barrel 105 may include one or more openings 115. The one or more openings 115 may be located within a first portion of the inner barrel 105 respective to the chamber end of the inner barrel 105. For example, the one or more openings 115 may be located at various positions between the chamber end of the inner barrel 105 and a second point that is between the chamber end of the inner barrel 105 and the center of the inner barrel 105. It should be understood that the one or more openings 115 may be located at any point along the length of the inner barrel 105 and that the one or more openings 115 may be located at any radial point on the inner barrel 105 (e.g., top, bottom, or any side of the barrel). It should be further understood that the distance between the one or more openings 115 may vary.

In embodiments, a chamber end seal 205 may be located on the outer surface of the inner barrel 105 at the chamber end of the inner barrel 105. For example, the chamber end seal 205 may be located on the outer surface of the inner barrel 105 at the point of the inner barrel 105 having an outer diameter that is greater than the diameter of the rest of the inner barrel 105. When the outer tube 110 is placed over the inner barrel 105, the chamber end seal 205 may prevent gases from escaping a void area (e.g., gas pressure relief chamber 120 of FIG. 1B) that is created between the outer surface of the inner barrel 105 and the inner surface of the outer tube 110. The chamber end seal 205 may be a rubber seal (e.g., rubber O-ring). It should be understood that the chamber end seal 205 may be made of various other materials (e.g., brass seal, bronze seal, etc.).

In embodiments, the outer surface of the inner barrel 105 may be threaded at the muzzle end of the inner barrel 105 (e.g., inner barrel threads 210). The inner barrel threads 210 may mate with threads of a muzzle end seal (e.g., gas pressure relief chamber seal 305 of FIG. 3).

Figure 2B:
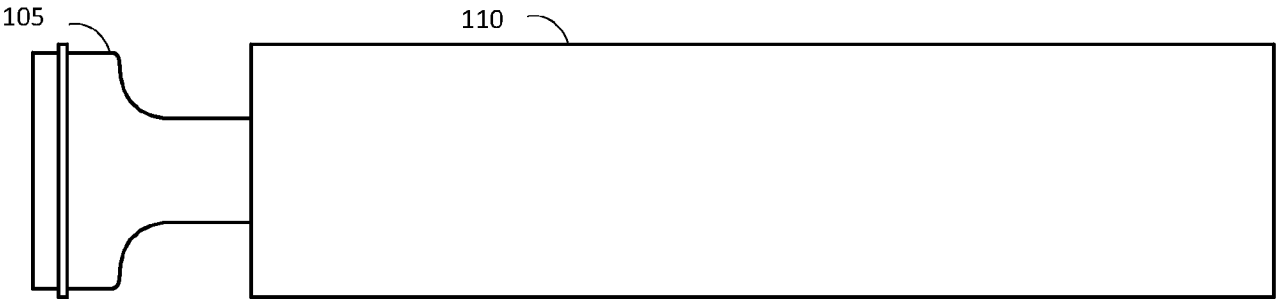
FIG. 2B is an exploded view of a firearm barrel showing an inner barrel and an outer tube.

FIG. 2B is an exploded view of a firearm barrel showing an inner barrel 105 and an outer tube 110. In embodiments, the outer tube 110 may be of the same length as the inner barrel 105, and the inner diameter of the outer tube 110 may be dimensioned so as to fit over the chamber end of the inner barrel 105 and to compress the chamber end seal 205. When the outer tube 110 is placed over the inner barrel 105 and the chamber end seal 205 is compressed, gases are effectively precluded from escaping out of the void area (e.g., gas pressure relief chamber 120 of FIG. 1B) created between the outer surface of the inner barrel 105 and the inner surface of the outer tube 110 through the chamber end of the void area.

In embodiments, the gas pressure relief chamber 120 of FIG. 1B may be sealed at both ends. It should be understood by one skilled in the relevant art that many different components may be used to seal the gas pressure relief chamber 120. For example, either end of the gas pressure relief chamber 120 may be sealed using one or more O-rings, threaded cap, direct welded cap, and others.

Figure 3:
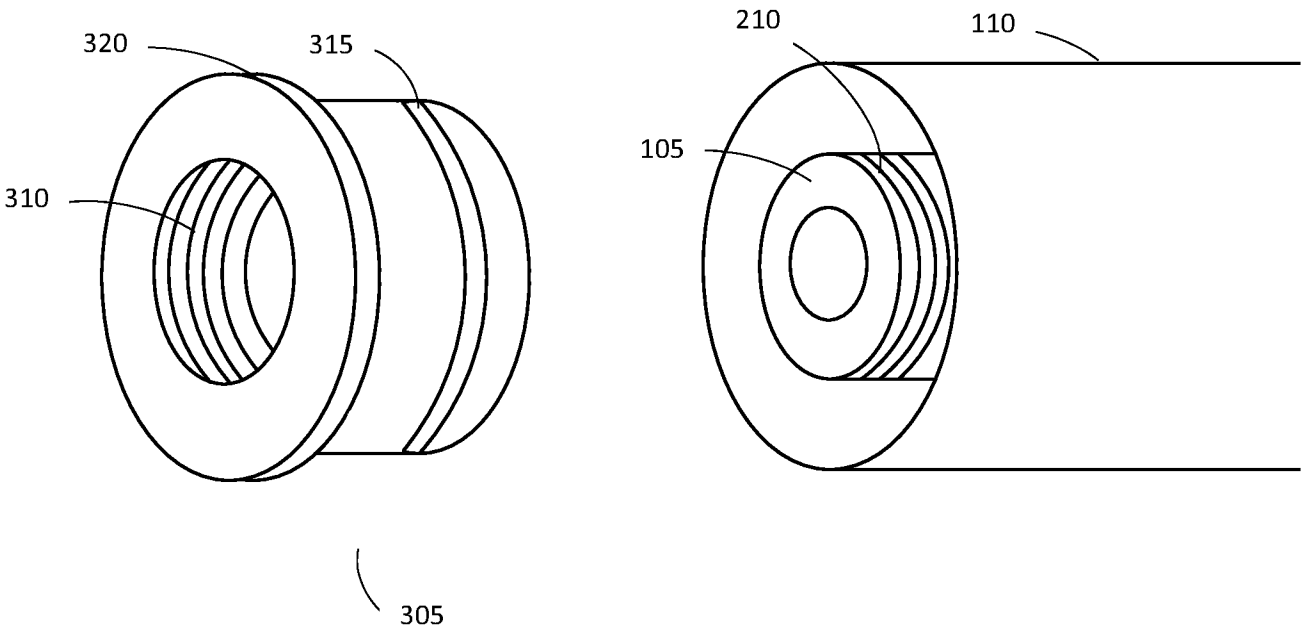
FIG. 3 is an exploded view of an example implementation of an inner barrel, an outer tube, and a gas pressure relief chamber seal.

FIG. 3 is an exploded view of an example implementation of an inner barrel 105, an outer tube 110, and a gas pressure relief chamber seal 305. In embodiments, the gas pressure relief chamber seal 305 may include threads 310 on the inner surface of an opening in the gas pressure relief chamber seal 305. The threads 310 may mesh or mate with the inner barrel threads 210, so that the gas pressure relief chamber seal 305 may be threaded onto the inner barrel 105 to create a seal at the muzzle end of the void area between the outer surface of the inner barrel 105 and the inner surface of the outer tube 110 (e.g., gas pressure relief chamber 120 of FIG. 1B). The gas pressure relief chamber seal 305 may be removable such that the area between the inner barrel 105 and the outer tube 110 may be cleaned in between use.

In embodiments, the gas pressure relief chamber seal 305 may include an inner seal 315, wherein the outer diameter of the inner seal 315 is dimensioned so as to be under compression from the outer tube 110 when the gas pressure relief chamber seal 305 is threaded onto the inner barrel 105. The inner seal 315 may be a rubber seal (e.g., rubber O-ring). It should be understood that the inner seal 315 may be made of various other materials (e.g., brass seal, bronze seal, etc.).

In embodiments, the gas pressure relief chamber seal 305 may include a cap seal 320. The cap seal 320 may have an outer radius dimensioned so as to cover the gap between the outer surface of the inner barrel 105 and the inner surface of the outer tube 110. The cap seal 320 may include a rubber seal such as a rubber O-ring or gasket. It should be understood that the cap seal 320 may be a brass or bronze seal. The inner diameter and outer diameter of the narrower section of the cap seal 320 may be dimensioned so as to significantly fill the gap between the outer surface of the inner barrel 105 and the inner surface of the outer tube 110 in order to create a seal at the muzzle end of the pressure relief chamber 120 of FIG. 1B.

Figure 4:
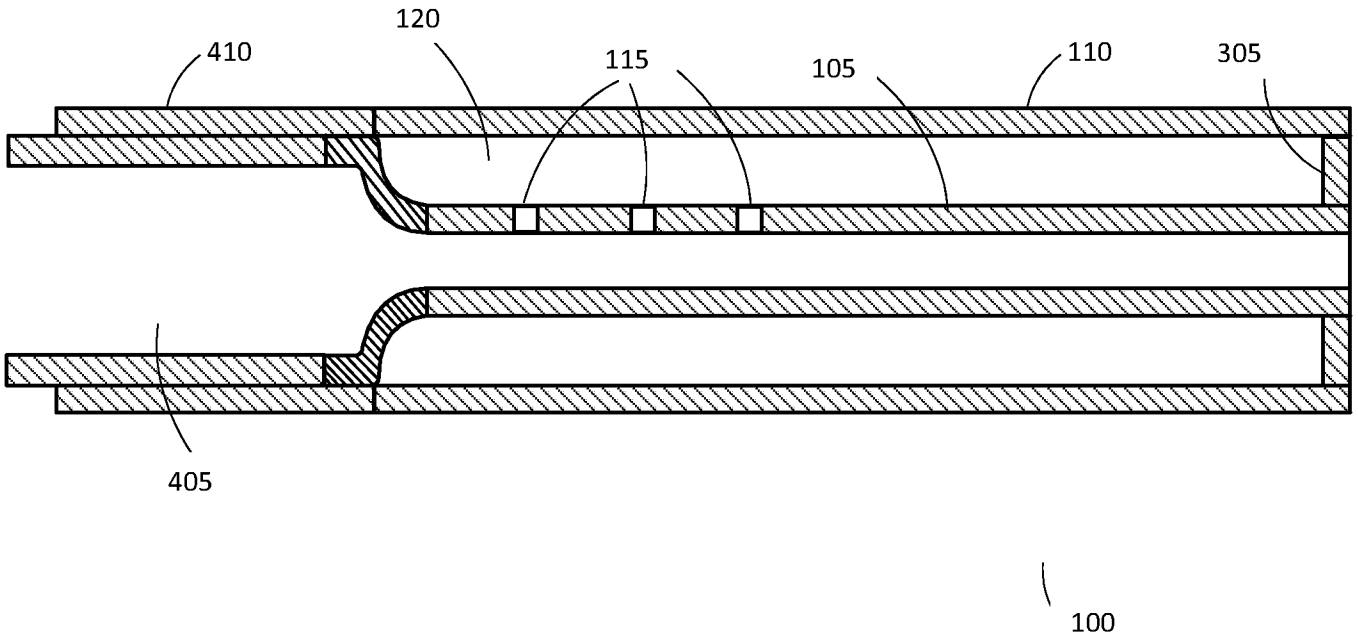
FIG. 4 is a cross-sectional side view of a firearm barrel.

FIG. 4 is a cross-sectional side view of a firearm barrel 100. The chamber end of the inner barrel 105 may be flush with the exit of a chamber 405, such that the inner barrel 105 may accept a projectile from the chamber 405. For example, the inner diameter of the inner barrel 105 may be equivalent to or nearly equivalent to the diameter of the exit of the chamber 405. When a projectile is ejected from the chamber 405, pressure forces the projectile into the inner barrel 105 and gases generated during the firing process follow the projectile out of the chamber 405 and continue to force the projectile through the inner barrel 105. As the projectile passes an opening 115 in the inner barrel 105 wall, gas that is forcing the projectile through the inner barrel 105 is allowed to escape through the opening 115 and into the gas pressure relief chamber 120. The resulting pressure relief serves to slow the speed of the projectile as it passes through the inner barrel 105, and also reduces the pressure of the gas prior to the projectile and gas exiting the barrel at the muzzle. The gas that is temporarily contained in the gas pressure relief chamber 120 may be allowed to travel back through the one or more openings 115 in the inner barrel 105 wall and out of the muzzle end of the inner barrel 105 after the projectile leaves the inner barrel 105.

In embodiments, the gas pressure relief chamber 120 can be sealed at both ends. For example, at the end of the gas pressure relief chamber 120 closest to the chamber 405, the gas pressure relief chamber 120 may be sealed by way of a connection of the outer tube 110 to the inner barrel 105 (e.g., chamber end seal 205 of FIG. 2A). At the muzzle end of the barrel 100, the gas pressure relief chamber 120 can be sealed using an O-ring and/or gas pressure relief chamber seal 305. It should be understood to those skilled in the art that there are many ways in which to seal the gas pressure relief chamber 120.

In embodiments, the chamber-end of the inner barrel 105 may be permanently affixed to a chamber 405 of a firearm. For example, the inner barrel 105 may be welded to the chamber 405, may be formed (e.g., molded) along with the chamber 405, or may be permanently affixed to the chamber 405 using various other methods. The inner barrel 105 may be formed along with the chamber 405 of a firearm such that the inner barrel 105 and chamber 405 form a single component of the firearm.

In embodiments, the firearm barrel 100 may be temporarily attached to a firearm. The end of the firearm barrel 100 closest to the chamber of the firearm itself may include a mechanism allowing the firearm barrel 100 to be temporarily attached to the firearm. For example, the outer surface of the outer tube 110 or inner barrel 105 may be threaded to mate with a threaded port leading to the chamber 405 of a firearm. As another example, a spring-loaded latch may be located at the end of the firearm barrel 100, and the spring-loaded latch may be locked to hold the firearm barrel 100 in place against the firearm.

It should be understood that the firearm barrel 100 can be attached to the chamber of a firearm using various means for attachment. For example, the firearm barrel 100 can be permanently (e.g., welding, etc.) or temporarily (e.g., threaded, bolted, etc.) installed with the chamber 405 of the firearm. It should be further understood that the attachment of the firearm barrel 100 to a firearm may be based upon current practices for attaching a barrel to a specific firearm. Therefore, the means for attaching the firearm barrel 100 to a firearm may vary between different firearm models.

In embodiments, the outer tube 110 may be permanently or temporarily affixed to the chamber 405. For example, a chamber-end of the outer tube 110 may be attached to or formed along with the chamber 405.

In embodiments, the outer tube 110 may be permanently or temporarily affixed to a base element of the inner barrel 105. For example, the chamber-end of the outer tube 110 may be attached to the base element of the inner barrel 105. As another example, the outer surface of the base element may be threaded and a portion of the inner surface of the outer tube 110 may be threaded to mate with the threading of the base element.

In embodiments, the void area created by the gap between the inner barrel 105 and outer tube 110 may be sealed at the muzzle-end by a gas pressure relief chamber seal 205. The gas pressure relief chamber seal 205 may be a gasket operable to prevent gas from escaping from the muzzle-end of the void area created by the gap between the inner barrel 105 and outer tube 110.

In embodiments, the void area created by the gap between the inner barrel 105 and outer tube 110 may be sealed at the chamber-end by a gasket or by forming the inner barrel 105 and outer tube 110 flush against the surface of a chamber 405. For example, the void area may be enclosed at the chamber-end by the exterior surface of the chamber 405.

In embodiments, the inner barrel 105 or outer tube 110 may fit into a receiver 410 associated with a firearm such that the entrance to the inner barrel 105 meets the exit of the chamber 405. It should be understood that various attachment mechanisms (e.g., blocks, bolts, etc.) may be used to hold the inner barrel 105 or outer tube 110 in place at the receiver. It will be appreciated by those skilled in the relevant art that the means for attaching the barrel 100 to a receiver 410 may vary according to the type of receiver 410 used with the firearm.

In embodiments, the inner barrel 105 and outer tube 110 may be held in place by way of the seal at each end of the barrel 100. For example, the gas pressure relief chamber seal 305 may hold the muzzle end of the inner barrel 105 and the muzzle end of the outer tube 110 in place, and the chamber end of the outer tube meeting the base element (e.g., the portion of the inner barrel 105 having the greatest diameter) of the inner barrel 105 may hold the chamber ends of the barrel components in place. Various types of seals (e.g., O-ring) may be used to hold the muzzle ends and chamber ends of the barrel components in place.

It should be understood that control over the speed of a bullet stemming from management of the gas expansion, pressure, flow and exit through the muzzle may be accomplished differently for various firearms. By varying the relative size of the outer tube to the inner barrel to alter the volume available for the gas escaping from the inner barrel and/or by changing the number, configuration, location, size and shapes of the openings in the inner barrel through which the gas escapes, accurate control over the pressure generated in the inner barrel by firing a round can be achieved.

It will be appreciated by those skilled in the relevant art that the technology described herein applies to barrels used with various types of firearms. For example, the technology may be applied to rifles, shotguns, handguns, and others. The number, position, shapes, and sizes of the openings may be configured according to the type of firearm. Additionally, firearms having multiple barrels may or may not be independently sealed, or connected using the same space (essentially forming a single gas detention chamber) and allowing the gases from each independent inner barrel to mix in the same space between the inner barrels and the outer barrel.

Moreover, it will be appreciated that various configurations of openings in the inner barrel may be used according to the power of ammunition used with the firearm. It should be understood that the technology described herein may be used with firearms having barrels of any length, caliber, and power, as well as fully automatic, semi-automatic and single-shot firearms.

It will be appreciated that the various components of the firearm barrel described herein may be made using various materials.

What is claimed is:

1. A firearm barrel comprising:

an inner barrel having a first diameter, wherein the inner barrel comprises a plurality of openings on a top surface of the inner barrel, wherein each respective one of the plurality of openings are located in parallel along the top surface of the inner barrel, and wherein a muzzle-end of an outer surface of the inner barrel comprises threads;

an outer tube surrounding the inner barrel, wherein the outer tube has a second diameter;

wherein the first diameter and second diameter are so dimensioned as to create a space between an outer surface of the inner barrel and an inner surface of the outer tube, and wherein the surface of the inner barrel comprising the plurality of openings separates an interior space of the inner barrel from the space between the outer surface of the inner barrel and the inner surface of the outer tube; and wherein the space between the outer surface of the inner barrel and the inner surface of the outer tube is sealed at a chamber-end and at a muzzle-end, wherein the space is sealed at the muzzle-end by a cap seal, the cap seal having an outer diameter and an inner diameter dimensioned so as to cover a gap between the outer surface of the inner barrel and the inner surface of the outer tube and so as to leave the muzzle-end of the inner barrel open, and wherein the cap seal comprises a hole aligned with a muzzle of the inner barrel and further comprises threads that mesh with the threads located on the muzzle-end of the outer surface of the inner barrel.

2. The firearm barrel of claim 1, wherein the inner barrel comprises a chamber-mount end and a muzzle end, and wherein the outer tube surrounds the inner barrel for an entire length of the inner barrel.

3. The firearm barrel of claim 2, wherein the chamber-mount end of the inner barrel comprises a temporary mount for temporarily affixing the inner barrel to a chamber of a firearm.

4. The firearm barrel of claim 2, wherein the chamber-mount end of the inner barrel comprises a fixed mount for affixing the inner barrel to the chamber of a firearm.

5. The firearm barrel of claim 1, wherein the plurality of openings on the surface of the inner barrel is located within a portion of the inner barrel that extends from the chamber-end of the inner barrel to a center point of the inner barrel, wherein the inner barrel extends from the chamber-end of the inner barrel to the muzzle-end of the inner barrel.

6. The firearm barrel of claim 1, wherein the gap between the outer surface of the inner barrel and the inner surface of the outer tube creates a void, and wherein the void is sealed at both ends.

7. The firearm barrel of claim 1, wherein an interior surface of the inner barrel comprises lands and grooves.

* * * * *